US005690748A

United States Patent [19]

Henriet

[11] Patent Number: 5,690,748

[45] Date of Patent: Nov. 25, 1997

[54] PROCESS FOR THE ACID PICKLING OF STAINLESS STEEL PRODUCTS

[75] Inventor: Dominique Henriet, Chambourcy, France

[73] Assignee: Ugine Aciers de Chatillon et Gueugnon, Gueugnon, France

[21] Appl. No.: 150,254

[22] Filed: Nov. 10, 1993

Related U.S. Application Data

[63] Continuation of Ser. No. 840,183, Feb. 24, 1992, abandoned.

[51] Int. Cl.[6] ..... C23G 1/02

[52] U.S. Cl. ..... 134/3; 134/10; 134/41; 252/79.3

[58] Field of Search ..... 134/2, 3, 10, 28, 134/41; 252/142, 79.3

[56] References Cited

U.S. PATENT DOCUMENTS

| | | | |
|---|---|---|---|
| 2,337,062 | 12/1943 | Page, Jr. | 134/3 |
| 2,474,526 | 6/1949 | Healy, Jr. et al. | 252/142 |
| 2,564,549 | 8/1951 | Stargardter | 134/3 |
| 2,856,275 | 10/1958 | Otto | 156/664 |
| 3,310,435 | 3/1967 | Robinson, Jr. et al. | 134/3 |
| 4,400,289 | 8/1983 | Geldner et al. | 134/3 X |
| 4,545,918 | 10/1985 | Pralus | 134/3 X |
| 4,608,091 | 8/1986 | Sullivan et al. | 134/3 |
| 4,707,191 | 11/1987 | Martinou et al. | 134/3 |
| 5,154,774 | 10/1992 | Bousquet et al. | 134/3 |
| 5,164,016 | 11/1992 | Henriet et al. | 134/3 X |
| 5,292,374 | 3/1994 | Maresch et al. | 134/3 |
| 5,354,383 | 10/1994 | Bianchi | 134/3 |

FOREIGN PATENT DOCUMENTS

| | | |
|---|---|---|
| 0 188 975 | 7/1986 | European Pat. Off. . |
| 2 551 465 | 3/1985 | France . |
| 2587369 | 3/1987 | France . |
| 3 222 532 | 12/1983 | Germany . |
| 48-97229 | 12/1973 | Japan . |
| 58-73778 | 5/1983 | Japan . |
| 80 019 110 | 3/1980 | Sweden . |
| 2 000 196 | 1/1979 | United Kingdom . |
| 2000196 | 1/1979 | United Kingdom . |

OTHER PUBLICATIONS

Stainless Steels In Industry, vol. 1, Third Edition, pp. 178–185, 1951, J. H. G. Monypenny, "Stainless Iron and Steel".

Hawley's Condensed Chemical Dictionary, 11th Edition, 1987, pp. 863, 866–867.

*Primary Examiner*—Robert J. Warden
*Assistant Examiner*—Saeed Chaudhry
*Attorney, Agent, or Firm*—Oblon, Spivak, McClelland, Maier & Neustadt, P.C.

[57] ABSTRACT

The invention relates to a process for pickling stainless steel products, in which the pickling bath used has as its initial composition, HF≧10 g/l, dissolved ferric iron ($Fe^{3+}$)≧15 g/l, and water=balance. During the pickling operation(s), the redox potential of the bath is monitored and maintained between +100 mV and +350 mV by oxidation of the bath, if necessary, by at least one or several addition(s) of oxidant to the bath. The process of the invention applies particularly to the industrial pickling of stainless steel sheets and strips, in which it is possible to avoid the use of nitric acid and the resulting pollution.

21 Claims, No Drawings

PROCESS FOR THE ACID PICKLING OF STAINLESS STEEL PRODUCTS

This application is a Continuation of application Ser. No. 07/840,183, filed on Feb. 24, 1992, now abandoned.

BACKGROUND OF THE INVENTION

1. Field of the Invention

This invention relates to processes for the surface treatment, and more particularly for the acid pickling or descaling, of stainless steel products.

2. Discussion of the Background

The acid pickling of stainless steels is usually performed using fluonitric baths, in which the disadvantage of using nitric acid is that it leads to the formation of nitrous vapors which pollute the atmosphere and soluble nitrates which pollute the liquid effluent. In the context of the continuous acid pickling of stainless steel sheet, the inventors have sought to develop a modified pickling process which, while remaining industrially economical, limits or, better still, avoids such pollution.

In "Stainless Iron and Steel" (Chapman & Hall Ltd, London 1951), J. H. G. Monypenny indicates (pp. 183–4) that, to minimize the problem of vapors from fluonitric pickling baths, stainless steel sheets have been pickled in baths containing from 6 to 12% of a 90% ferric sulphate solution and 1.5 to 3% of hydrofluoric acid, e.g., at 70° to 80° C., to descale a hot-rolled sheet. The initial concentration of ferric iron in the baths used hitherto is thus from about 16.5 to 33 g/l. The inventors' tests have shown that when successive samples of stainless steel sheets are pickled in baths of this kind, the rate and quality of pickling deteriorate rapidly. These acid pickling baths are therefore not satisfactory as such for serial or continuous pickling of stainless steel products.

It is also known to use pickling baths containing hydrofluoric acid and oxygenated water. Industrial pickling tests on strips of stainless steel have been carried out by the inventors, who noticed temperature surges in the baths as well as a considerable consumption of oxygenated water, which made the process very expensive compared with the fluonitric process for pickling stainless steels. In this process, the replacement of nitric acid by oxygenated water therefore does not appear to be suitable for industrial application.

There is accordingly a strongly felt need for a process for acid pickling stainless steel products which does not suffer the above-noted disadvantages.

SUMMARY OF THE INVENTION

Accordingly, objects of the present invention include providing a novel process for the acid pickling of stainless steel products, which process is economical and minimizes, or avoids, pollution-related problems.

The inventors have now discovered a process which satisfied the above objects of the invention and other objects which will become apparent from the description of the invention given herein below. This process for pickling stainless steel products uses a pickling bath having, as an initial composition, (i) HF present in an amount of at least 10 g/l and up to 100 g/l or more, including 150 g/l, (ii) dissolved ferric iron ($Fe^{3+}$) in an amount of at least 15 g/l, and (iii) water as the balance. No particular temperature needs to be used, but a temperature of between 15° and 70° C. is convenient to use. In accordance with the invention, during the pickling operation or operations, the ferric iron content of the bath is maintained at at least 15 g/l. This may be achieved, if necessary, by oxidation of the bath.

Oxidation of the bath in accordance with the present invention is achieved by addition to the bath of at least one member selected from the group consisting of ozone ($O_3$), chlorine ($Cl_2$), water vapor, inorganic and organic peroxides including hydrogen peroxide, peracids, or persalts such as chlorates, perchlorates, persulfates, permanganates (e.g. $KMnO_4$) or chlorites of the alkaline earth and alkali metals. Combinations of two or more of these oxidants may be used in accordance with the invention.

DETAILED DESCRIPTION OF THE PREFERRED EMBODIMENTS

For practical industrial use, and particularly for repeated or continuous pickling of stainless steel products in at least one large vat, typically one or more pickling baths are used, initially containing at least 10 g/l and up to 100 g/l or more including 150 g/l, preferably 10 to 50, g/l, of HF and ≧15, preferably ≧20, g/l of $Fe^{3+}$. During the pickling operation or operations the $Fe^{3+}$ content of this bath or these baths is maintained at at least 15 g/l, preferably at least 20 g/l. This can be achieved, if necessary, by oxidation of the or each bath, comprising one or more addition of oxidant into the pickling bath.

The oxidant seems to participate in the process of the invention to regenerate $Fe^{2+}$ into $Fe^{3+}$, whereas $F^{3+}$ constitutes an oxidizing agent acting on the base metal to dissolve it. The essential reactions appear to be as follows:

(i) A dissolution reaction:

$$2\,Fe^{3+} + Fe \underset{2}{\overset{1}{\rightleftharpoons}} 3\,Fe^{2+} \qquad (A)$$

in which the equilibrium is almost totally shifted in direction 1 under normal pickling conditions;

(ii) Another dissolution reaction:

$$Fe^{3+} + 2HF \leftrightharpoons H_2\uparrow + FeF_2 \qquad (B)$$

also possible in an oxidizing medium, which is the case;

(iii) And oxidation of $Fe^{2+}$ by the oxidant in the pickling solution, possibly supplemented by another means of oxidation:

$$4\,Fe^{2+} + \text{oxidant} \underset{4}{\overset{3}{\rightleftharpoons}} 4\,Fe^{3+} + \text{reduced oxidant} \qquad (C)$$

in which the equilibrium is strongly shifted in direction 3 if the solution is correctly oxidized and if the pH of the pickling bath is between about 1 and 3.

The ferric iron content of the bath can be calculated as the difference between the total iron concentration, measured by atomic absorption, for example, and the $Fe^{2+}$ concentration measured by its oxidation into $Fe^{3+}$ in the presence of permanganate, e.g., $KMnO_4$. Oxidation of the pickling bath in accordance with the invention, by the addition of oxidant, makes it possible to maintain the quality of pickling in the course of successive pickling operations or continuous pickling of stainless steel products, while regenerating $Fe^{3+}$.

Peroxides which may be used in accordance with the presentinvention include, in addition to hydrogen peroxide, peroxyurea (i.e., $CO(NH_2)_2.H_2O$) or percarbonic acid (i.e., $H_4(CO_3)_2.3H_2O_2$). Peracids which may be used in accordance with the present invention include perboric acid, peracidic acid, percarbonic acid, perbenzoic acid, persulfuric acid, perphosphoric acid, periodic acid, and perphthalic acid. Persalts which may be used in accordance with present invention conclude sodium percarbonate and magnesium percarbonate.

The total amount of oxidant added into the pickling bath depends essentially on the quantity of stainless steel pickled, and is proportional to the surface area pickled and the duration of pickling of this surface. So that the pickling bath is properly oxidized, it is preferred to add a good proportion of the oxidant, typically at least half of the amount to be added to the bottom of the bath (i.e., in the lower half of the bath). The oxidant added is preferably preheated to a temperature similar to that of the bath, i.e. typically between 35° and 60° C.

For industrial use of the pickling bath, recharging with HF is carried out in the usual manner. And, rather than determining the $Fe^{3+}$ concentration of the bath, it is practical to determine the redox potential of the bath and regulate it between 0 mV and +800 mV, preferably between 100 and +350 mV, and more preferably between +100 mV and 300 mV, if necessary, by adjusting the oxidation of the bath through addition of the oxidant. The reference redox potential is selected in accordance with the grade and surface condition of the strip and readjusted, if necessary, in accordance with observations of the surface condition after pickling.

The redox potential may be measured between a platinum electrode and an Ag/AgCl reference electrode or a reference electrode with a fixed potential, reproducible and with zero power of irreversibility. A device for measuring this redox potential can be suitably made leaktight so that continuous measurements can be taken in the bath.

Depending on the $Fe^{3+}$ concentration found, or more conveniently depending on the value of the redox potential, there may be a need for an oxidation means which temporarily and/or locally supplements the action of the oxidant used in order to arrive more quickly at the desired $Fe^{3+}$ concentration or the set redox potential, so as to achieve good pickling. In this case, the addition of a stronger oxidizing agent is used as the supplementary oxidizing means.

The inventors have also found that it was possible to modify the solubility of the sludge or precipitate from the spent bath by regulating the redox potential of the bath during pickling. The "sludge" is not very soluble when the bath is regulated below +100 mV or above +300 mV to +350 mV, and its solubility is greatly improved at between +100 mV and +300 mV, more particularly between +190 mV and +260 mV, whilst the optimum setting for the bath is +220 mV±20 mV.

For a spent bath which has thus been used to pickle strips of stainless steel with a redox potential of between +200 and +240 mV, and containing about 60 g/l of iron in the form of "sludges" of precipitated fluorides, this sludge may be recycled into a new bath as follows. The liquid is removed from (e.g., sucked out of the) spent bath, then hot water (e.g., 50° to 60° C.) is run onto the sludge to solubilize it, then the HF content is adjusted by adding free HF (15 to 20 g/l) and the whole is agitated. Then a little oxidant is added to adjust the potential to about +220 mV and a fresh bath is obtained. This possibility of recycling the sludge is particularly valuable on an industrial scale. It appears that this favorable dissolution of the sludge is linked to the precipitation of a mixed iron fluoride, the majority of which is formed between +100 mV and +300 mV and more particularly between +190 mV and +260 mV.

The pickling bath is generally prepared using ferric fluoride, ferric sulphate or ferric chloride, with a ferric iron concentration of between 15 and 40 g/l, with a preference for ferric fluoride, so that there is only one acid radical in the bath.

The pickling process according to the invention is used for stainless steel sheets or strips, typically with the following initial HF concentrations and pickling temperatures:

ferritic stainless steels: HF=10 to 25 g/l, 35°–50° C.

austenitic stainless steels: HF=20 to 35 g/l, 40°–60° C.

Apart from solving the pollution problem set forth above, the pickling process according to the invention brings about major advantages for industrial exploitation including:

regulation of the quality of the bath is all the more convenient and accurate as the majority of the oxidation is effected by the or each addition of oxidant;

regulation of the level of the oxidation reduction potential makes it possible to obtain "sludges" which can be re-used directly in the form of a new bath.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the U.S. is:

1. A process for pickling a stainless steel product, comprising:

providing a pickling bath having a redox potential and consisting essentially of (i) HF in an amount of from 60 grams per liter to 150 grams per liter, (ii) dissolved $Fe^{3+}$ ions as the pickling agent, (iii) at least one oxidizing agent selected from the group consisting of ozone, chlorine, water vapor, alkaline earth and alkaline metal permanganates, peroxyurea, percarbonic acid, perboric acid, perbenzoic acid, persulfuric acid, perphosphoric acid, periodic acid, perphthalic acid, sodium precarbonate and magnesium percarbonate, and (iv) water; and inserting said stainless steel product into said pickling bath wherein, during the pickling operation, the redox potential of said bath is monitored and maintained between about +100 mV and about +350 mV.

2. The process of claim 1, wherein said process is carried out in a plurality of vats.

3. The process of claim 1, wherein the content of $Fe^{3+}$ in said bath is monitored and maintained at at least 15 grams per liter.

4. The process of claim 1, wherein the content of $Fe^{3+}$ in said bath is monitored and maintained at at least 20 grams per liter.

5. The process of claim 1, wherein said permanganate is $KMnO_4$.

6. The process of claim 1, wherein ferritic stainless sheets or strips are pickled.

7. The process of claim 6, wherein ferritic stainless sheets are pickled.

8. The process of claim 6, wherein ferritic stainless steel strips are pickled.

9. The process of claim 1, wherein austenitic stainless sheets or strips are pickled, and the pickling bath temperature is between 15° C. and 70° C.

10. The process of claim 9, wherein said temperature is between 40° C. and 60° C.

11. The process of claim 9, wherein austenitic stainless sheets are pickled.

12. The process of claim 9, wherein austenitic stainless strips are pickled.

13. The process of claim 1, wherein after said pickling is finished, the sludge of the spent bath is recycled by removing liquid from said spent bath, running hot water over said sludge to solubilize same, adjusting said HF content by adding HF and agitating the mixture thus obtained and adding an amount of said oxidizing agent sufficient to adjust the redox potential of said bath to between +200 mV and +240 mV, to obtain a fresh pickling bath.

14. The process of claim 6, wherein said $Fe^{3+}$ ions are present in said bath in a concentration of between 15 and 40 grams per liter and where the redox potential of said bath is monitored and maintained between about +100 mV and +300 mV.

15. The process of claim 1, wherein said oxidizing agent is preheated to a temperature similar to that of said bath prior to being added to said bath.

16. The process of claim 1, wherein the bath has a temperature of between 35° C. and 60° C. during the pickling operation.

17. The process of claim 1, wherein the redox potential of said bath is monitored and maintained between +100 mV and +300 mV.

18. The process of claim 1, wherein the redox potential of said bath is monitored and maintained between +100 mV and +260 mV.

19. The process of claim 1, wherein the redox potential of said bath is monitored and maintained at +220 mV±20 mV.

20. The process of claim 1, wherein ferric fluoride, ferric sulphate, or ferric chloride is used in providing said pickling bath.

21. The process of claim 1, wherein ferric fluoride is used in providing said pickling bath.

* * * * *